US008410885B2

(12) United States Patent
Tseng et al.

(10) Patent No.: US 8,410,885 B2
(45) Date of Patent: Apr. 2, 2013

(54) COMBINED TRANSFORMER

(75) Inventors: Hsiang-Yi Tseng, Taoyuan Hsien (TW); Hsin-Wei Tsai, Taoyuan Hsien (TW); Ming-Cheng Lee, Taoyuan Hsien (TW); Yi-Lin Chen, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 13/238,219

(22) Filed: Sep. 21, 2011

(65) Prior Publication Data

US 2012/0242444 A1 Sep. 27, 2012

(30) Foreign Application Priority Data

Mar. 22, 2011 (TW) ..... 100109633 A

(51) Int. Cl.
*H01F 27/30* (2006.01)

(52) U.S. Cl. ..... 336/198; 336/196

(58) Field of Classification Search ..... 336/196, 336/198, 212, 220, 221, 232
See application file for complete search history.

(56) References Cited

U.S. PATENT DOCUMENTS

| | | | | |
|---|---|---|---|---|
| 3,675,174 | A * | 7/1972 | Horbach | 335/299 |
| 4,166,265 | A * | 8/1979 | Reynolds et al. | 336/192 |
| 4,701,735 | A * | 10/1987 | Hill et al. | 335/282 |
| 4,800,357 | A * | 1/1989 | Nickels et al. | 336/198 |
| 5,952,907 | A * | 9/1999 | McWilliams et al. | 336/83 |
| 6,771,157 | B2 * | 8/2004 | Nishikawa et al. | 336/178 |
| 7,154,366 | B2 * | 12/2006 | Hsueh et al. | 336/198 |
| 7,183,889 | B2 * | 2/2007 | Fushimi | 336/208 |
| 7,221,252 | B1 | 5/2007 | Chang | |
| 7,456,719 | B2 * | 11/2008 | Suzuki et al. | 336/198 |
| 7,884,692 | B2 * | 2/2011 | Yen et al. | 336/90 |
| 8,013,710 | B2 * | 9/2011 | Lai et al. | 336/212 |
| 2008/0278274 | A1 | 11/2008 | Kang et al. | |

FOREIGN PATENT DOCUMENTS

| | | |
|---|---|---|
| TW | 200845058 | 11/2008 |
| TW | M375276 | 3/2010 |

* cited by examiner

*Primary Examiner* — Mohamad Musleh
*Assistant Examiner* — Joselito Baisa
(74) *Attorney, Agent, or Firm* — Grossman, Tucker, Perreault & Pfleger, PLLC

(57) ABSTRACT

A combined transformer is provided. The transformer comprises at least three bobbins arranged abreast and a core assembly. Each of the bobbins includes two separated guard plates, a winding column, a through groove and two metal pins; the winding column is disposed between the guard plates, while the through groove extends through the guard plates and the winding column. Furthermore, the two metal pins are disposed on one of the guard plates; the winding column is wound with a coil, and two end portions of the coil are connected to the two metal pins respectively. The core assembly includes two separated magnetic plates and at least three separated magnetic columns disposed between the magnetic plates. The bobbins are sandwiched between the magnetic plates, and the magnetic columns are located in the through grooves. Thus, the combined transformer can have a reduced thickness and multiple outputs.

12 Claims, 10 Drawing Sheets

COMBINED TRANSFORMER

CROSS-REFERENCES TO RELATED APPLICATIONS

This application claims priority to a Taiwan Patent Application No. 100109633 filed on Mar. 22, 2011, which is hereby incorporated herein by reference in its entirety.

BACKGROUND OF THE INVENTION

1. Field of the Invention

The present invention provides a transformer, and more particularly, a combined transformer.

2. Descriptions of the Related Art

Some electronic products have a transformer structure disposed therein to adjust the voltage level of an external power supply into an appropriate level so that other electronic components in the electronic products can be powered by the external power supply.

As electronic products evolve towards a thinner profile, the volume of electronic components in the electronic products must be reduced. Certainly, the volume of the transformer structure must also be reduced. However, to meet the safety regulations in which there is no short circuiting between the core assembly and coils thereof, the conventional transformer structure must have a protection cover disposed between the core assembly and the coils to increase the creepage distance therebetween. The protection cover adds to the overall thickness of the transformer structure, which is unfavorable for the reduction of the volume of the transformer structure.

In view of this, an urgent need exists in the art to provide a transformer structure that can overcome the aforesaid shortcoming.

SUMMARY OF THE INVENTION

An objective of the present invention is to provide a combined transformer which has a reduced thickness.

Another objective of the present invention is to provide a combined transformer which has multiple outputs.

A further objective of the present invention is to provide a combined transformer which allows for the easy expansion of the number of bobbins.

To achieve the aforesaid objectives, the combined transformer disclosed by the present invention comprises at least three bobbins and a core assembly. The bobbins each have a first guard plate, a second guard plate, a winding column, a through groove and two first metal pins. The second guard plate is separated from the first guard plate. The winding column is disposed between the first guard plate and the second guard plate. The through groove extends through the first guard plate, the second guard plate and the winding column. The two first metal pins are disposed on the second guard plate. The winding column is wound with a first coil, and the two end portions of the first coil are connected to the two first metal pins respectively. The bobbins are arranged abreast. The core assembly has two separated magnetic plates and at least three separated magnetic columns disposed between the two magnetic plates. The bobbins are sandwiched between the two magnetic plates, and the magnetic columns are located in the through grooves of the bobbins respectively.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1:
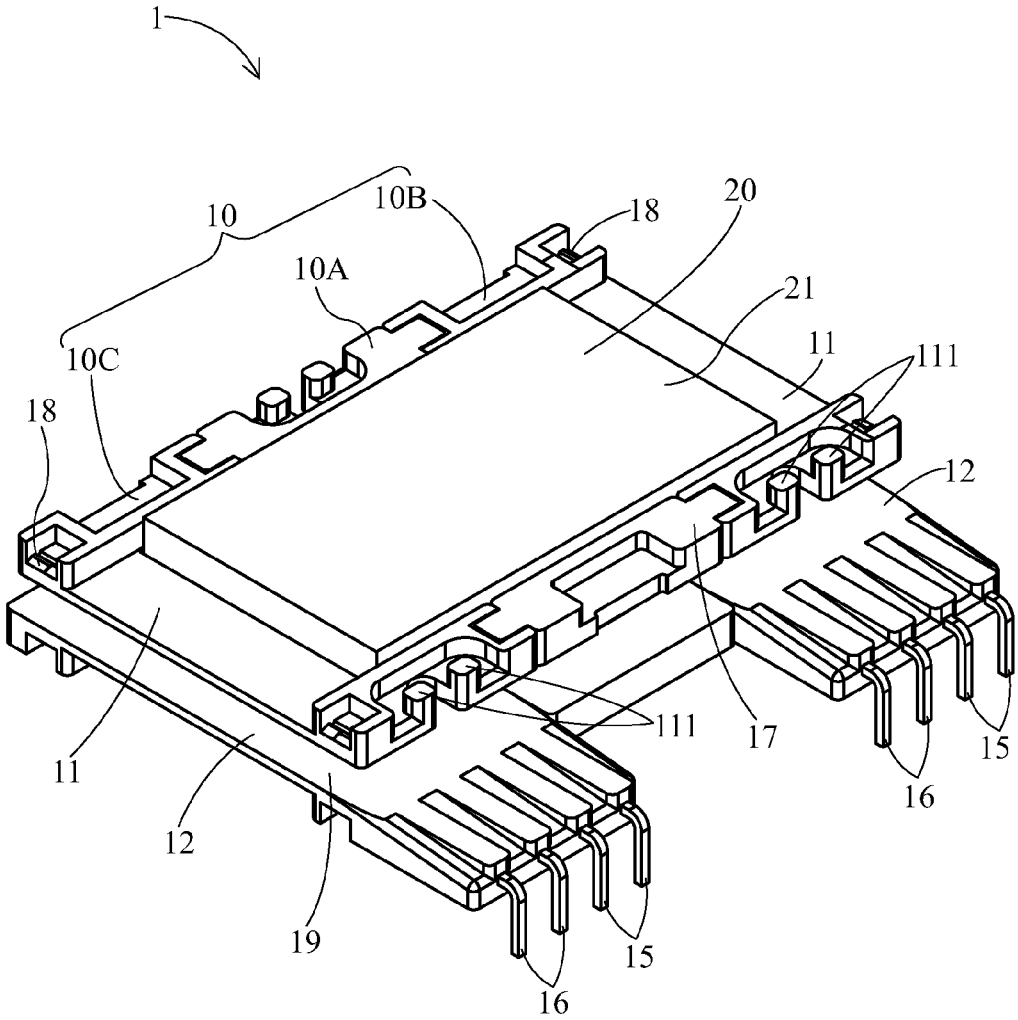
FIG. 1 is an assembly view illustrating the first preferred embodiment of a combined transformer of the present invention.
Figure 2:
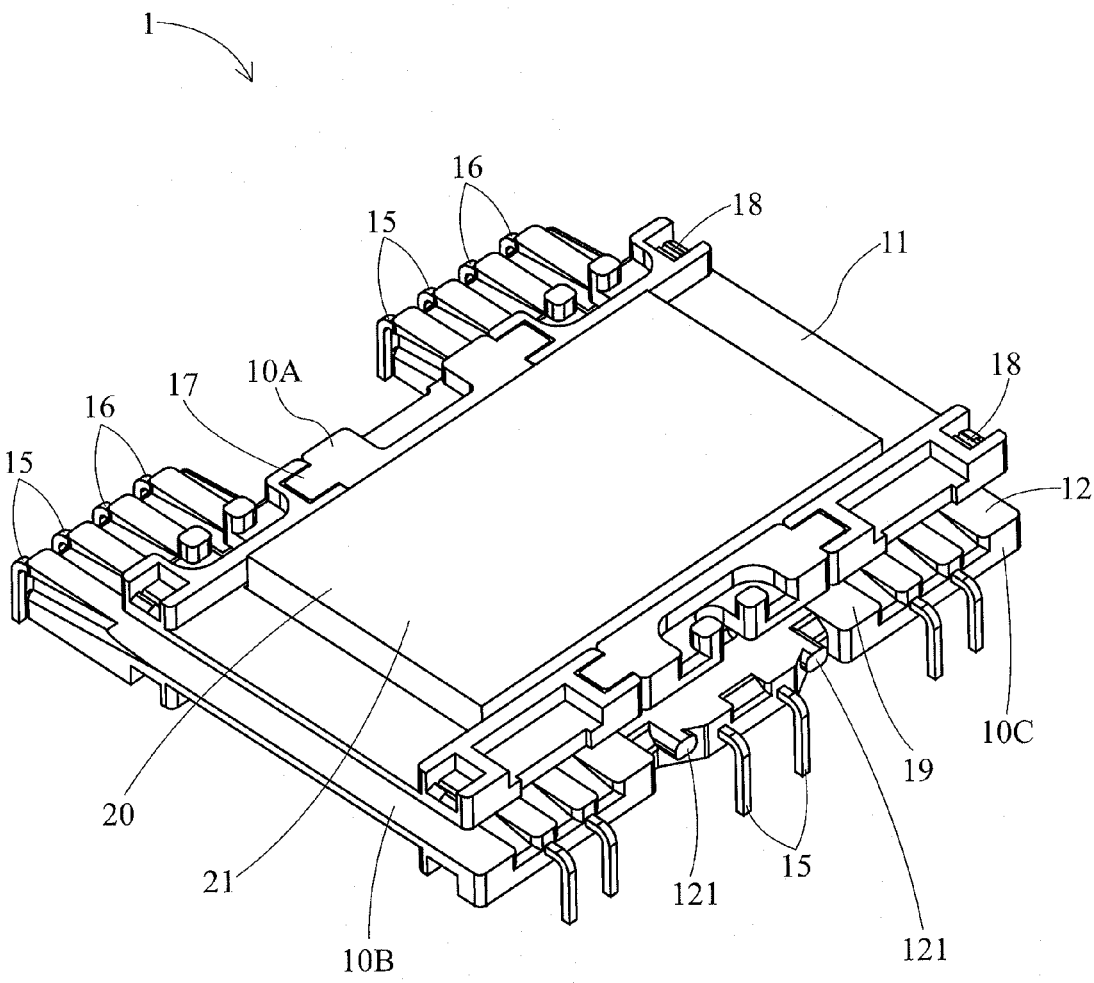
FIG. 2 is an assembly view illustrating the first preferred embodiment of the combined transformer of the present invention from another viewing angle.
Figure 3:
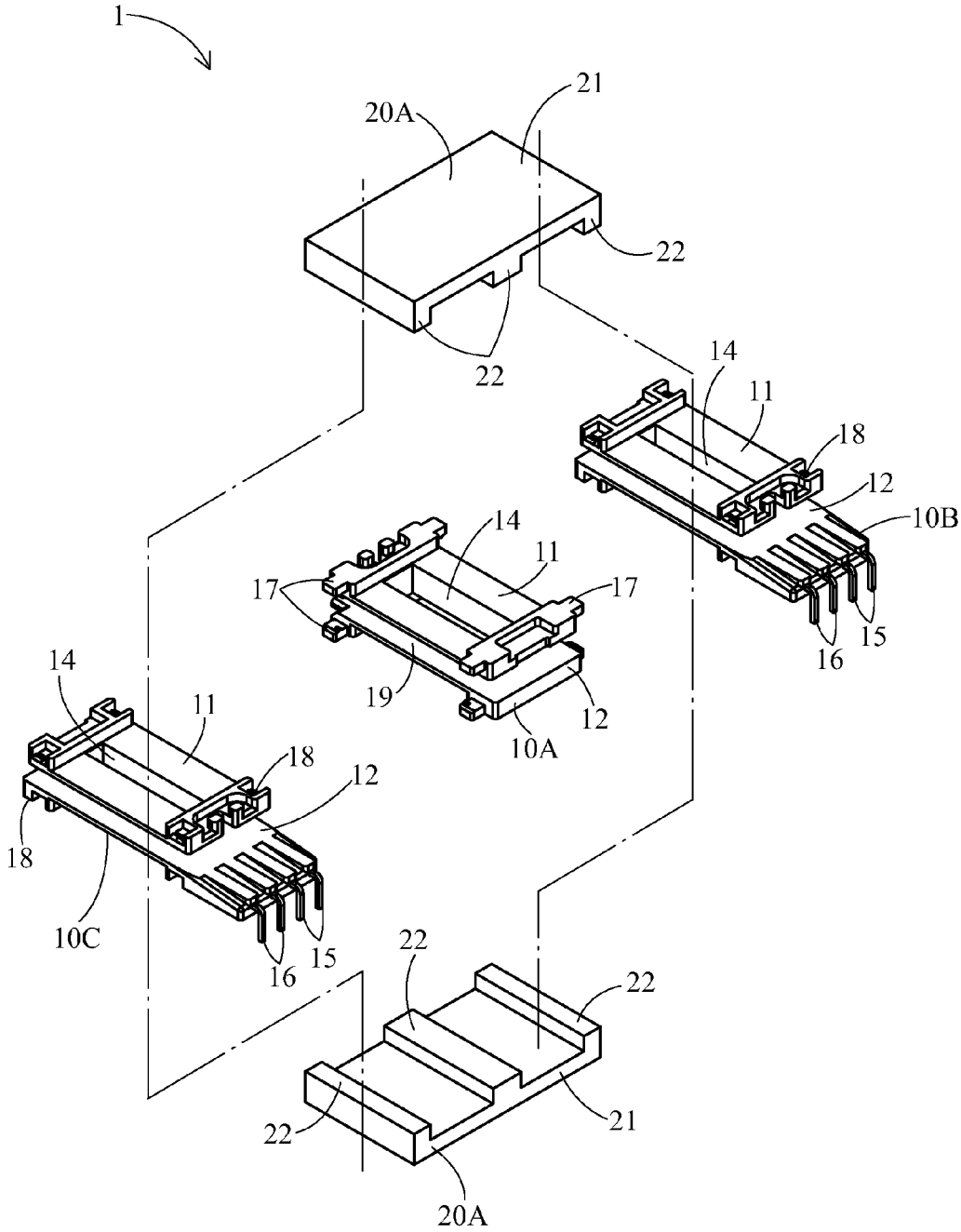
FIG. 3 is an exploded view illustrating the first preferred embodiment of the combined transformer of the present invention.

FIGS. 1 to 3 illustrate perspective assembly views and a perspective exploded view illustrating the first preferred embodiment of a combined transformer of the present invention respectively. The combined transformer 1 comprises at least three bobbins 10 and a core assembly 20. Hereinafter, members of the combined transformer 1 will be described in sequence.

For convenience of the description, the three bobbins 10 will be referred to as the first bobbin 10A, second bobbin 10B and third bobbin 10C respectively. The first bobbin 10A may serve as a primary bobbin, while the second bobbin 10B and the third bobbin 10C may serve as secondary bobbins. In other words, the combined transformer 1 of this embodiment can output at least two currents.

The bobbins 10A, 10B and 10C are manufactured separately and then arranged abreast. The first bobbin 10A may be located between the second bobbin 10B and the third bobbin 10C; i.e., the second bobbin 10B and the third bobbin 10C are not adjacent to each other. The shapes of the second bobbin 10B and the third bobbin 10C may be substantially the same (although slight differences may exist due to manufacturing tolerances), so the second bobbin 10B and the third bobbin 10C can be manufactured by a same mould. Furthermore, there is no need to particularly distinguish between the second bobbin 10B and the third bobbin 10C when the bobbins 10A, 10B and 10C are assembled by a user, which simplifies the assembling operations and reduces the assembling period.

Next, the detailed structures of the bobbins 10A, 10B and 10C will be described. The bobbins 10A, 10B and 10C each have a first guard plate 11, a second guard plate 12, a winding column 13, a through groove 14 and two first metal pins 15; and each of the second bobbin 10B and the third bobbin 10C further has two second metal pins 16.

The first guard plate 11 is separated from the second guard plate 12 to define a winding space 19. The winding column 13 is disposed between the first guard plate 11 and the second guard plate 12, and may be integrally formed with the first guard plate 11 and the second guard plate 12. The through groove 14 vertically extends through the first guard plate 11, the winding column 13 and the second guard plate 12. The two first metal pins 15 are disposed on the second guard plate 12, although there is no limitation on the positions of the first metal pins 15.

Figure 4:
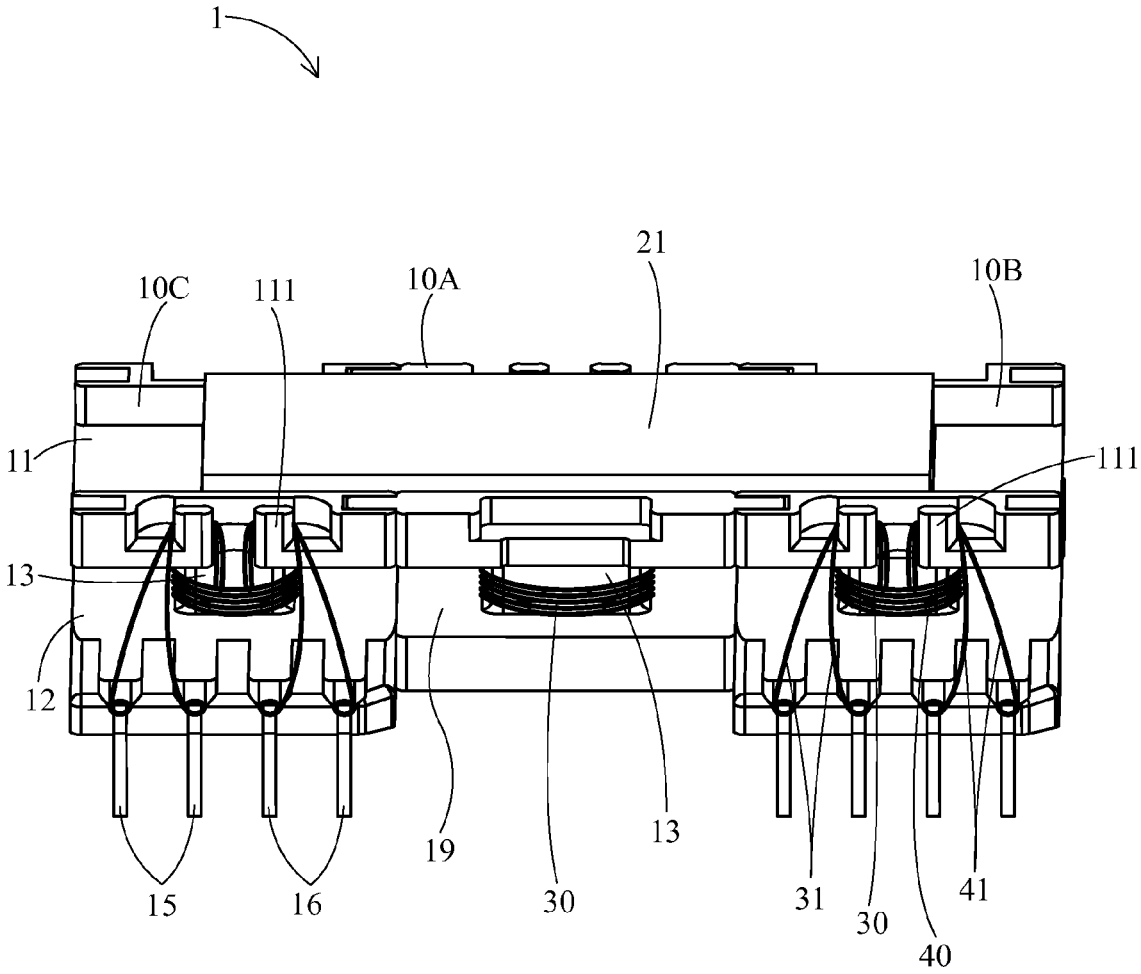
FIG. 4 is a schematic view illustrating the first preferred embodiment of the combined transformer of the present invention and coils.
Figure 5:
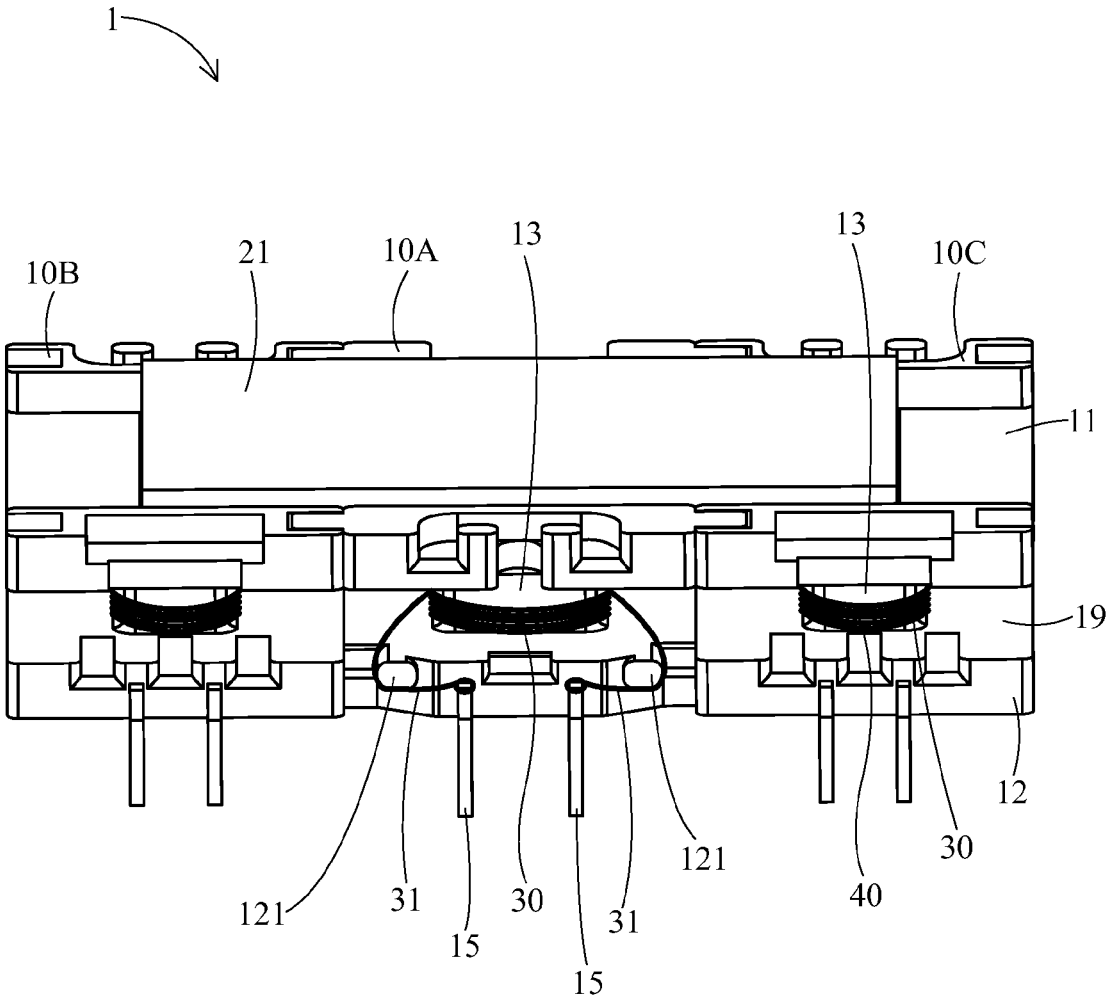
FIG. 5 is another schematic view illustrating the first preferred embodiment of the combined transformer of the present invention and the coils.

In reference to FIGS. 4 and 5, the winding column 13 can be wound with a first coil 30, and the two end portions 31 (portions that are not wound around the winding column 13) of the first coil 30 are connected to the two first metal pins 15 respectively. The winding column 13 of each of the second bobbin 10B and the third bobbin 10C can be further wound with a second coil 40, and the two end portions 41 of the second coil 40 are connected to the two second metal pins 16 respectively. In other words, the second bobbin 10B and the third bobbin 10C each have two coils 30 and 40; and thus, each of the second bobbin 10B and the third bobbin 10C can output two currents, while the whole combined transformer 1 can output at least four currents.

It shall be appreciated that the first coil 30 wound around the first bobbin 10A may be a copper wire (an enameled wire); while the first coil 30 and the second coil 40 wound around each of the second bobbin 10B and the third bobbin 10C may be a triple insulation wire (a copper wire coated with three insulation layers). In this way, the insulativity between "the first coil 30 around the first bobbin 10A" and "the first coil 30 and the second coil 40 around the second bobbin 10B" can be enhanced; and similarly, the insulativity between the first coil 30 around the first bobbin 10A and the first coil 30 and the second coil 40 around the third bobbin 10C can also be enhanced.

Additionally, as no other partition is disposed between the first guard plate 11 and the second guard plate 12, the winding space 19 is not partitioned. Therefore, each of the bobbins 10A, 10B and 10C may be viewed as a single-slot bobbin. The single-slot bobbin allows the machine or user to wind the first coil 30 (or the second coil 40) around the bobbin easily. However, each of the bobbins 10A, 10B and 10C may also be optionally designed to be a multi-slot bobbin (not shown); i.e., the winding space 19 may be partitioned by at least one partition.

In reference to both FIGS. 4 and 5 again, the two end portions 31 of the first coil 30 are connected to the first metal pins 15, and this is often accomplished through soldering. During the soldering process, the two end portions 31 of the first coil 30 need to be applied with soldering tin, however, the high-temperature soldering tin tends to cause damage to the enamel cover (or the insulation layers) of the end portions 31. Furthermore, if the end portions 31 are not long enough, then apart from causing damage to the enamel cover of the end portions 31, the high-temperature soldering tin may also cause damage to a part of the enamel cover of the first coil 30 wound around the winding column 13, thus, resulting in short circuiting of the first coil 30.

In order to avoid this issue, the second guard plate 12 of the first bobbin 10A is further formed with two protrusions 121 in this embodiment so that the end portions 31 of the first coil 30 can have an increased length; the two first metal pins 15 may be located between the two protrusions 121. The two end portions 31 of the first coil 30 are wound around the two protrusions 121 to connect the two first metal pins 15 respectively. In this way, the end portions 31 each have an additional length section for being wound around the protrusions 121, so the overall length of each of the end portions 31 can be increased.

Similarly, the first guard plate 11 of each of the second bobbin 10B and the third bobbin 10C is also formed with two protrusions 111. The two end portions 31 of the first coil 30 are wound around the two protrusions 111 to connect the two first metal pins 15 respectively; and the two end portions 41 of the second coil 40 are also wound around the two protrusions 111 to connect the two second metal pins 16 respectively. In this way, the overall length of each of the end portions 31 of the first coil 30 wound around each of the second bobbin 10B and the third bobbin 10C can be increased, and the overall length of each of the end portions 41 of the second coil 40 can also be increased.

In reference to FIGS. 1 to 3 again as described above, the bobbins 10A, 10B and 10C are arranged abreast. To prevent the bobbins 10A, 10B and 10C that are arranged abreast from being easily separated from each other, some fixing means such as an adhesive, an adhesive tape, screws or bolts may be provided to adjacent two of the bobbins 10A, 10B and 10C.

The fixing means employed in this embodiment are hooks 17 and slots 18. In detail, the first bobbin 10A is formed with a plurality of hooks 17 on the first guard plate 11 and the second guard plate 12 thereof; and each of the second bobbin 10B and the third bobbin 10C is formed with a plurality of slots 18 on the first guard plate 11 and the second guard plate 12 thereof. When the first bobbin 10A and the second bobbin 10B (or the third bobbin 10C) are arranged abreast, the hooks 17 hook the slots 18 so that the first bobbin 10A and the second bobbin 10B cannot be easily separated. When the first bobbin 10A is separated from the second bobbin 10B, the user can apply great force to deform the hooks 17 so that the hooks 17 are disengaged from the slots 18.

Thus, the bobbins 10 have been described above. Hereinafter, the core assembly 20 will be described.

Figure 6:
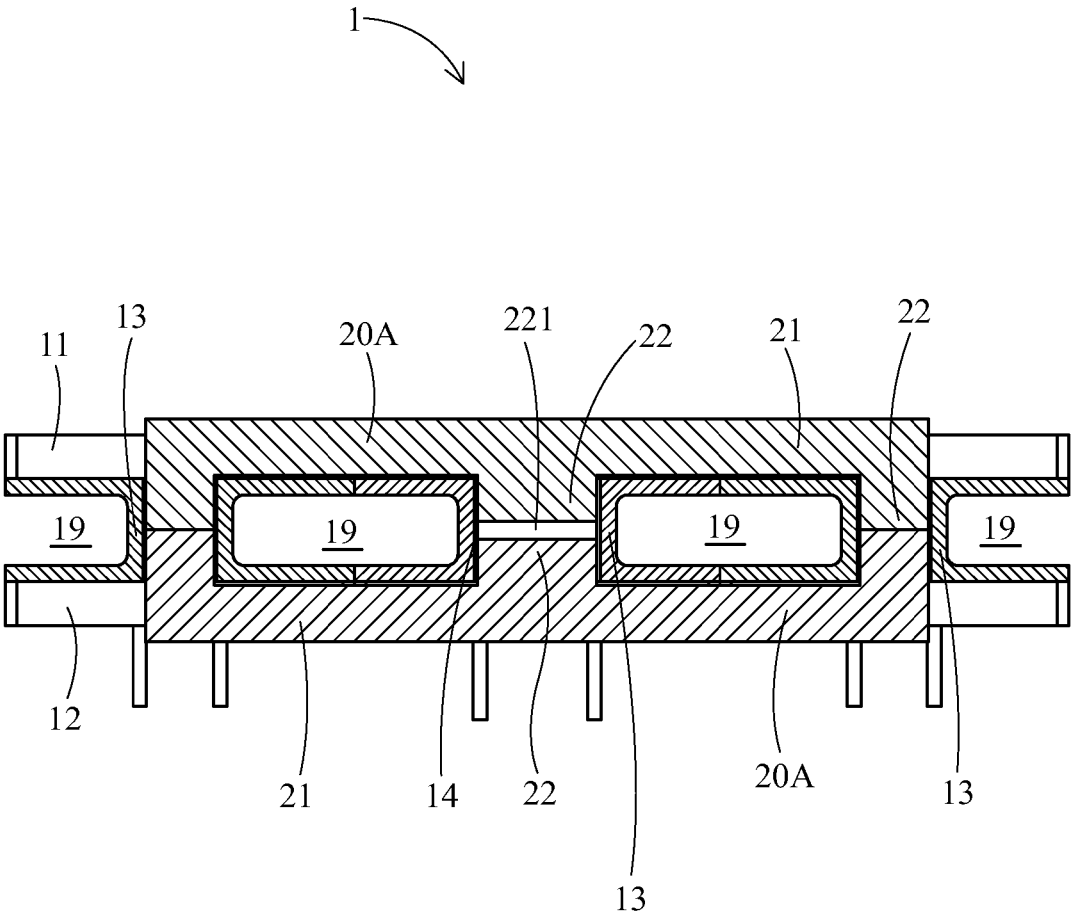
FIG. 6 is a cross-sectional view illustrating the first preferred embodiment of the combined transformer of the present invention.

In reference to FIG. 6, the core assembly 20 may comprise at least two cores 20A, each of which may be integrally formed by a magnetic material (e.g., a metal) or may be stacked by a plurality of magnetic materials (e.g., silicon steel sheets). In this embodiment, the core assembly 20 comprises two cores 20A each having an E-shaped cross section, so the core assembly 20 may be called an EE-type core assembly.

Figure 7A:
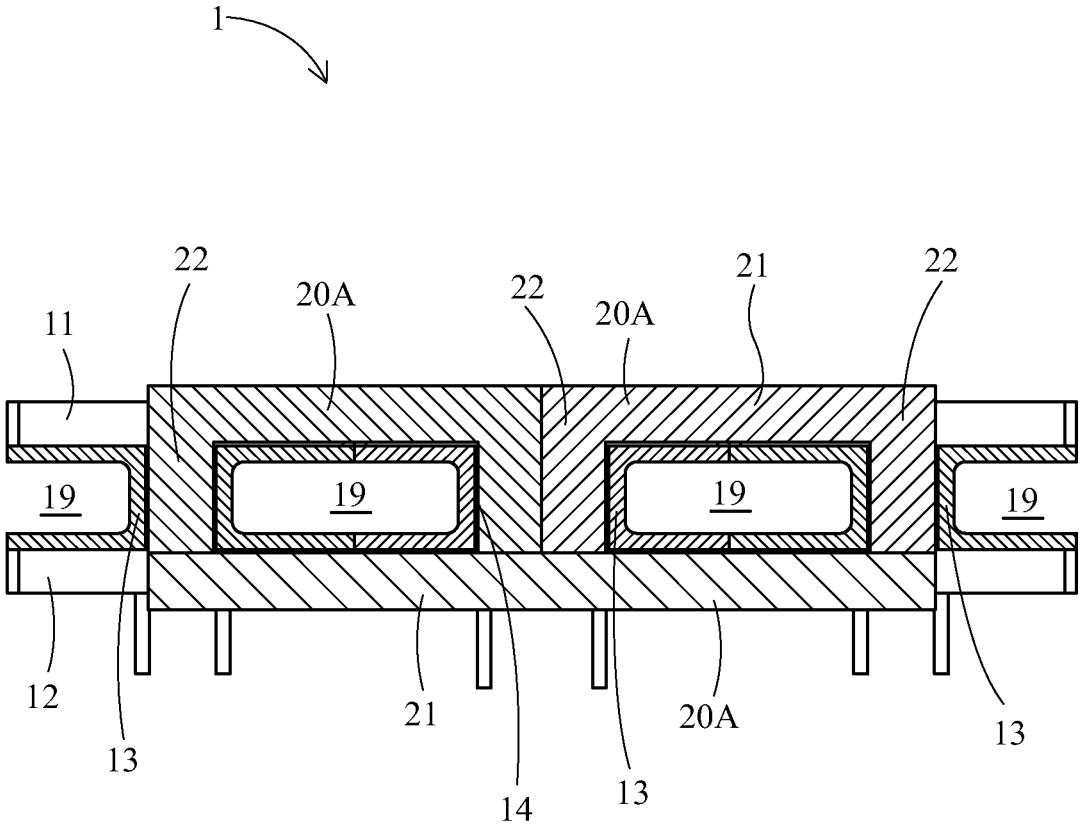
FIG. 7A is another cross-sectional view illustrating the first preferred embodiment of the combined transformer of the present invention.

In reference to FIG. 7A, the core assembly 20 may also comprise three cores 20A, of which two have a U-shaped cross section and the other one has an I-shaped cross section; in this case, the core assembly 20 may be called a UI-type core assembly. In reference to FIG. 7B, the core assembly 20 may further comprise a core 20A with an E-shaped cross section and a core 20A with an I-shaped cross section, in which case the core assembly 20 may be called an EI-type core assembly. In reference to FIG. 7C, the core assembly 20 may further comprise four cores 20A each having a U-shaped cross section, in which case the core assembly 20 may be called a UU-type core assembly.

Figure 7B:
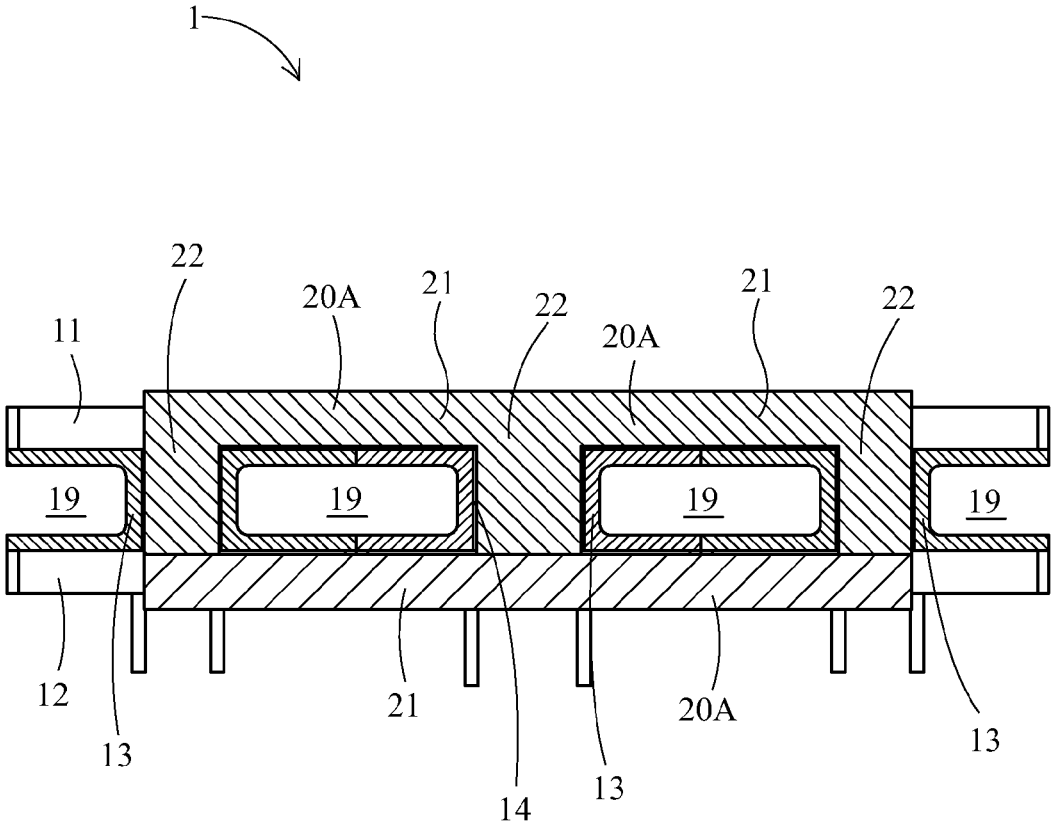
FIG. 7B is a further cross-sectional view illustrating the first preferred embodiment of the combined transformer of the present invention.
Figure 7C:
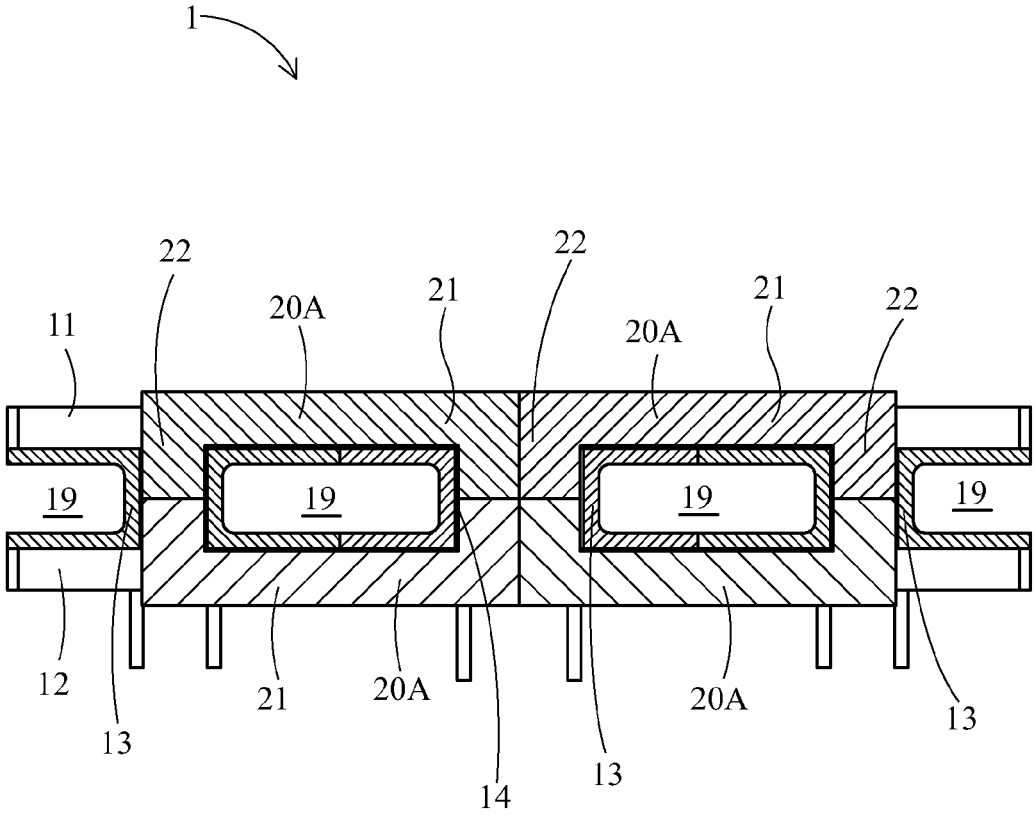
FIG. 7C is yet a further cross-sectional view illustrating the first preferred embodiment of the combined transformer of the present invention.

Regardless of the types, the core assemblies 20 all share common structural features. In detail, each of the core assemblies 20 on the whole has two separated magnetic plates 21 and at least three separated magnetic columns 22 disposed between the two magnetic plates 21. Each of the magnetic plates 21 may be formed by a plurality of cores 20A jointly (as shown in FIG. 7A), or may be formed by one core 20A alone (as shown in FIG. 7B); and each of the magnetic columns 22 may be formed by a plurality of cores 20A jointly (as shown in FIG. 7A), or may be formed by one core 20A alone (as shown in FIG. 7B).

When the core assembly 20 is assembled with the bobbins 10, the bobbins 10 are sandwiched between the two magnetic plates 21, and the magnetic columns 22 are located in the through grooves 14 of the bobbins 10 respectively. It is worth noting that the magnetic column 22 located in the through groove 14 of the first bobbin 10A (the primary bobbin) is formed with an air gap 221, which can overcome the shortcoming of leakage of inductance of the core assembly 20.

After the core assembly 20 is assembled with the bobbins 10, the core assembly 20 can be isolated from the first coils 30 and the second coils 40 in the bobbins 10 by means of the bobbins 10, so the insulativity between the core assembly 20 and the first coils 30 and the second coils 40 is increased. That is, the bobbins 10 can lead to an increased creepage distance between the core assembly 20 and the first coils 30 and the second coils 40, so there is no need to worry about the clearance distance between the core assembly 20 and the first coils 30 and the second coils 40.

Therefore, the combined transformer 1 of this embodiment can eliminate the need of an additional protection cover that is required in the prior art, so the overall thickness of the combined transformer 1 can be reduced.

Figure 8:
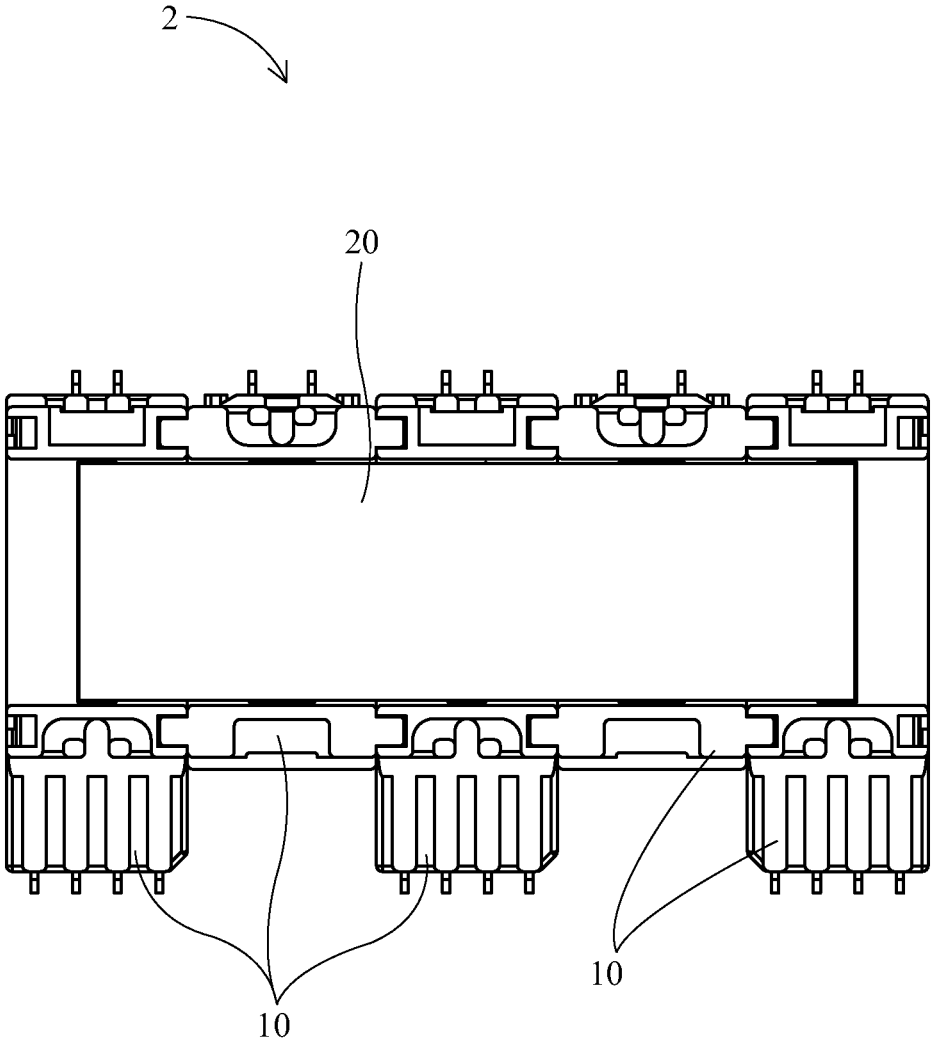
FIG. 8 is an assembly view illustrating the second preferred embodiment of the combined transformer of the present invention.

FIG. 8 illustrates a plan assembly view of the second preferred embodiment of the combined transformer of the present invention. The combined transformer 2 differs from the combined transformer 1 of the first embodiment in that: the combined transformer 2 has more than three bobbins 10. The user can optionally expand the number of the bobbins 10, and can define which of the bobbins 10 is used as a primary bobbin and which of the bobbins 10 is used as a secondary bobbin. The number of the magnetic columns 22 of the core assembly 20 increases with the number of the bobbins 10. Details identical to the first embodiment will not be further described herein.

According to the above descriptions, the combined transformer of the present invention has at least the following advantages:

1. the combined transformer of the present invention can have the core assembly isolated from the coils without the need of an additional protection cover, so it can have a reduced thickness;

2. the combined transformer of the present invention can comprise at least two secondary bobbins, so it can have at least two outputs;

3. the combined transformer of the present invention allows for expanding the number of bobbins, so the number of inputs or outputs of the combined transformer can be expanded;

4. the combined transformer of the present invention is formed with protrusions to increase the length of the end portions of each coil, so the possibility of a short circuit of the coil is reduced; and 5. the combined transformer of the present invention is formed with hooks and slots, so the bobbins can be combined and separated easily.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A combined transformer, comprising:

at least three bobbins, each having a first guard plate, a second guard plate, a winding column, a through groove and two first metal pins, wherein the second guard plate is separated from the first guard plate, the winding column is disposed between the first guard plate and the second guard plate, the through groove extends through the first guard plate, the second guard plate and the winding column, the two first metal pins are disposed on the second guard plate, the winding column is wound with a first coil, and two end portions of the first coil are connected to the two first metal pins respectively, wherein the bobbins are arranged abreast, the second guard plate of one of the bobbins is formed with two protrusions, the two end portions are wound around the two protrusions to connect the two first metal pins respectively, so that parts of the two end portions are suspended between the respective first metal pins and the respective protrusions; and a core assembly, having two separated magnetic plates and at least three separated magnetic columns disposed between the magnetic plates, wherein the bobbins are sandwiched between the two magnetic plates, and the magnetic columns are located in the through grooves of the bobbins respectively.

2. The combined transformer of claim 1, wherein the bobbins separate the core assembly from the first coils so as to increase a creepage distance between the core assembly and the first coils.

3. The combined transformer of claim 1, wherein adjacent two of the bobbins are formed with a plurality of hooks and a plurality of slots respectively, and the hooks hook the slots respectively.

4. The combined transformer of claim 1, wherein one of the bobbins is defined as a primary bobbin, and the magnetic column located in the through groove of the primary bobbin is formed with an air gap.

5. The combined transformer of claim 1, wherein the core assembly is constructed by at least two cores.

6. The combined transformer of claim 5, wherein each of the cores is formed integrally by a magnetic material.

7. The combined transformer of claim 5, wherein the core assembly is an EE-type core assembly, a UI-type core assembly, an EI-type core assembly or a UU-type core assembly.

8. The combined transformer of claim 1, wherein one of the first coils is formed by a triple insulation wire.

9. The combined transformer of claim 1, wherein one of the bobbins further has two second metal pins, the two second metal pins are disposed on the second guard plate, the winding column is further wound with a second coil, and two end portions of the second coil are connected to the two second metal pins respectively.

10. The combined transformer of claim 1, wherein nonadjacent two of the bobbins are of substantially the same shape.

11. The combined transformer of claim 1, wherein each of the bobbins is a single-slot bobbin.

12. A combined transformer, comprising:

at least three bobbins, each having a first guard plate, a second guard plate, a winding column, a through groove and two first metal pins, wherein the second guard plate is separated from the first guard plate, the winding column is disposed between the first guard plate and the second guard plate, the through groove extends through the first guard plate, the second guard plate and the winding column, the two first metal pins are disposed on the second guard plate, the winding column is wound with a first coil, and two end portions of the first coil are connected to the two first metal pins respectively, wherein the bobbins are arranged abreast, the first guard plate of one of the bobbins is formed with two protrusions, the two end portions are wound around the two protrusions to connect the two first metal pins respectively, so that parts of the two end portions are suspended between the respective first metal pins and the respective protrusions; and a core assembly, having two separated magnetic plates and at least three separated magnetic columns disposed between the magnetic plates, wherein the bobbins are sandwiched between the two magnetic plates, and the magnetic columns are located in the through grooves of the bobbins respectively.

* * * * *